United States Patent [19]

Vincent

[11] 4,030,732

[45] June 21, 1977

[54] HARNESS FOR THE TEACHING OF TENNIS

[76] Inventor: Max Vincent, 12 Rue de la Republique 06500, Menton, France

[22] Filed: Oct. 15, 1975

[21] Appl. No.: 622,707

[30] Foreign Application Priority Data

Oct. 17, 1974 France ..... 74.39737

[52] U.S. Cl. ..... 273/29 A; 273/191 R

[51] Int. Cl.[2] ..... A63B 61/00

[58] Field of Search ..... 273/29 A, 29 R, 183 B, 273/185 C, 188 R, 191 B, 191 R, 190 A, 190 B, 189 R, 73 R, 54 B, 186 R, 67 C, 75, 81, 162 R, 192, 194 R, 193 A, 26 C

[56] References Cited

UNITED STATES PATENTS

| | | | |
|---|---|---|---|
| 3,595,583 | 7/1971 | Oppenheimer | 273/191 B |
| 3,858,881 | 1/1975 | Hurwitz | 273/29 A |
| 3,937,465 | 2/1976 | Roland | 273/29 A |

*Primary Examiner*—Richard C. Pinkham
*Assistant Examiner*—T. Brown

[57] ABSTRACT

A tennis practice appliance having an adjustable chest band, held up by a pair of adjustable shoulder braces and a pair of elastic tapes adapted to be fixed to the skirt or trouser belt of the wearer. A ring is fitted to the right or left brace as desired near to the shoulder joint and a rubber spring is connected to the ring and hooked onto the handle of the racquet through a second ring which is placed immediately next to the thumb and the base of the index fingers.

6 Claims, 2 Drawing Figures

HARNESS FOR THE TEACHING OF TENNIS

BACKGROUND OF THE INVENTION

The present invention relates to a tennis practice appliance and, in particular, to an appliance for preventing beginners at lawn-tennis from acquiring any faulty habit or posture.

It is a well known fact, wherever games are taught, that beginners adopt postures that lack elegant form and efficacity. However, when teaching lawn-tennis, as with other games, the instructor cannot guide every step and every gesture of the pupil, and his advice does not have a continuous effect throughout the execution of a movement. Such advice has even less effect throughout a practical teaching session.

It is the object of the present invention to provide a remedy for the foregoing inconveniences and to provide an appliance which acts like a tutor rigorously, continuously and without ever slackening in effort.

It is a particular object to provide an elastic appliance limiting the extension of the arm beyond a certain range. An appliance of this kind is indispensable because the action of the arm that holds the racquet loses all its efficacity when it is totally extended. On the other hand, when the various muscles are only partially extended, they form a stable arrangement that is perfectly efficient in maintaining the limb for the execution of various movements. On the contrary, when the arm is totally extended, support comes from the bone foundations alone and then resistance to stress and strain is quite inadequate.

SUMMARY OF THE INVENTION

According to the present invention, a tennis practice appliance is provided comprising an adjustable chest band, held up by a pair of shoulder braces which are also adjustable. Two elastic adjustable tapes are fixed to the back section of the chest band joining the band to the skirt or trouser belt of the wearer. A ring is fitted to the right or left brace, according to whether the pupil is right-handed or left-handed and is situated near to the shoulder joint. An extensible link such as a rubber spring is connected to the ring and hooks onto the handle of the racquet through a second ring which is placed immediately next to the thumb and the base of the index fingers. The rings may be held in position by a self-ticking tape or by a "Velcro" type fastener equipped with interpenetrating hairs.

DESCRIPTION OF THE INVENTION

Figure 1:
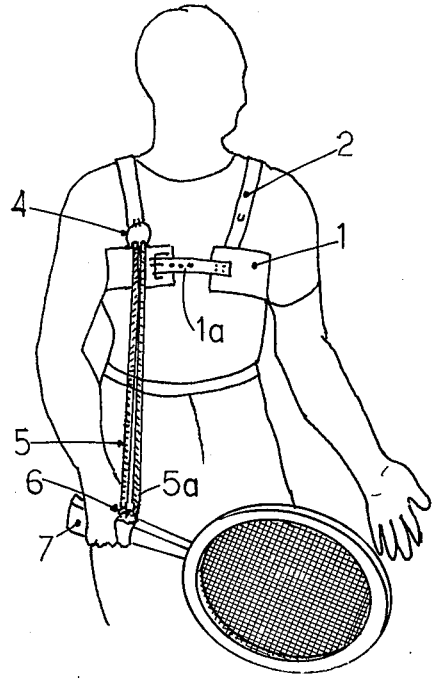
FIG. 1 is a view of the torso of a player provided with the tennis practice of the present invention.
Figure 2:
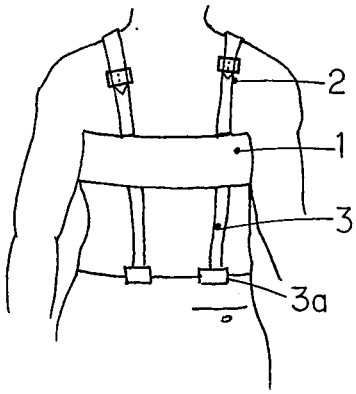
FIG. 2 is a partial view of the back of the player showing the appliance secured to the skirt or trouser of the player.

FIG. 1 shows the front view of the upper part of the body of a player, using his right arm. A chest band 1, having buckle means 1*a* for adjustable fit to a player, is held up by a pair of adjustable braces 2, which, as seen in FIG. 2, extend over the right and left shoulders, respectively, of the player. The back of the chest band 1 is joined by elastic tapes 3 having clip fasteners 3*a* for attachment to the player's belt section of a lower garment, such as the trousers or the skirt. A ring 4 is fixed by a self-sticking fastener such as "Velcro" or the like to the right brace of the player viewed from the front in FIG. 1 and an extensible rubber spring 5 passes loopedly through the upper ring 4 and is attached by hooks 5*a* at its ends to a second ring 6 fixed to the handle 7 of the tennis racquet. For the left-handed player, the ring 4 is affixed to the left shoulder brace. The self-stick fastener may be formed in part on the ring and on the brace.

This type of attachment allows extension of the arm's stretch and swing according to the anatomy of the player and his physical abilities. The positions which the hand normally follows when held at the end of a fully extended arm, when considered as a whole, defines approximately a sphere. With the elastic extensible band attached near to the shoulder joint, the reach of the arm, while circumscribed or limited at the end of the half-extended arm, will still follow the normally approximately a sphere, without any difficulty. In the lowermost position of the arm, the elastic extensible band will reduce, at least in part, the weight of the racquet, while in the highermost position of the arm or when serving, the elastic band contributes to the rotatory movement of the wrist. In all cases, the player is freed from concern for keeping his arm partially bent which the elastic band enforces and he is obliged to play with the upper part of the body leaning forward, the legs slightly bent, all in the attitude and form of one who is ready to reply to an unexpected attack.

The present appliance is suitable in all the cases of the teaching of lawn-tennis and especially when it is used by a pupil whose instruction is incomplete or faulty. It can also be of use in the case of experienced lawn-tennis players since it diminishes phyiscal fatigue and nervous wear. In any case, this invention increases the readiness to play of the player, and his pugnacity and agressiveness.

I claim:

1. A tennis practice appliance to be worn by a tennis trainee comprising: an elongated flexible band having a length to encircle the chest of a tennis trainee, said appliance and band having front and back sections when worn by the trainee; means at each end of said band cooperating to secure said band around the chest of said trainee; said band having secured thereto a pair of elongated shoulder braces, each said brace having its ends secured to said front and back sections of said band such that when said appliance is worn by said trainee, one of said braces extends over the left shoulder and the other of said braces extends over the right shoulder of said trainee; an elongated elastic link, said link having connecting means at each of its ends for conecting one of its ends to at least one of said braces at the front section of said appliance and for connecting its other end to a tennis racquet; a pair of elongated elastic tapes, each of said tapes having one of its ends attached to said back section of said band and means at its other end for releasable attachment to a lower garment, such as the belt section of a skirt or trousers of a tennis trainee.

2. The tennis practice appliance of claim 1, including a first ring adapted to be secured to at least a selected one of said braces at the front section of said appliance where said end of said link is attached to said appliance, said end of said link being attached to said left brace by said ring for a left-hand tennis trainee and being attached to said right brace by said ring for a right-hand tennis trainee.

3. The tennis practice appliance of claim 2, wherein at least one of said first ring and said braces are provided with cooperating self-sticking fastening means for attaching said ring to said braces.

4. The tennis practice appliance of claim 1, wherein a second ring is provided for attachment to the handle section of a tennis racquet, each end of said link is provided with means for attachment to said third ring whereby one end of said link is looped through said first ring on one of said braces and the ends of said link are attached to said third ring when attached to the handle of a tennis racquet.

5. The tennis practice appliance of claim 4, wherein said second ring is provided with self-sticking tape sections for securement to said tennis racquet.

6. The tennis practice appliance of claim 4, whereby means is provided to adjust the length of said band and said shoulder braces, whereby the size of said appliance may be varied to accommodate wearing by tennis trainees of various sizes.

* * * * *